United States Patent [19]

Bakermans

[11] Patent Number: 4,753,145

[45] Date of Patent: Jun. 28, 1988

[54] FEEDING AND SHEARING APPARATUS FOR STRIP MATERIAL

[75] Inventor: Johannes C. W. Bakermans, Harrisburg, Pa.

[73] Assignee: AMP Incorporated, Harrisburg, Pa.

[21] Appl. No.: 32,149

[22] Filed: Mar. 27, 1987

[51] Int. Cl.[4] ..... B26D 5/22; B26D 7/06

[52] U.S. Cl. ..... 83/227; 74/45; 83/247; 83/278; 83/356.2; 83/620; 83/628; 83/734

[58] Field of Search ..... 83/241, 244, 227, 229, 83/257, 265, 268, 270, 278, 416, 734, 454, 628, 222, 247, 356.2, 620; 74/45, 47

[56] References Cited

U.S. PATENT DOCUMENTS

| | | | |
|---|---|---|---|
| 1,153,723 | 9/1915 | Stedman | 74/45 |
| 1,788,098 | 1/1931 | Fuller | 74/45 |
| 1,931,760 | 10/1933 | Hermansdorfer | 83/268 |
| 2,912,814 | 11/1959 | Witt et al. | 52/513 |
| 3,174,347 | 3/1965 | Hecht | 74/38 |
| 3,500,709 | 3/1970 | Landman | 83/278 |
| 3,553,836 | 1/1971 | Cootes | 29/866 |
| 4,403,407 | 9/1983 | Mazzola | 29/749 |

*Primary Examiner*—E. R. Kazenske
*Assistant Examiner*—Hien H. Phan
*Attorney, Agent, or Firm*—Bruce J. Wolstoncroft; Frederick W. Raring

[57] ABSTRACT

A bell crank type strip feeding apparatus is disclosed in which one arm of the bell crank is coupled to an actuator and the other arm has a feed pawl thereon for feeding the strip. The actuator is a crank pin which is moved along a circular path about a fixed center. The intermediate pivot of the bell crank is mounted for movement along an arcuate path in response to the circular motion of the crank pin. The intermediate pivotal axis of the bell crank is yieldingly supported so that it can move laterally of the arcuate axis path when the feed pawl engages a fixed stop. A shearing mechanism is also disclosed for shearing the strip material at the conclusion of the feeding stroke.

7 Claims, 6 Drawing Sheets

FEEDING AND SHEARING APPARATUS FOR STRIP MATERIAL

FIELD OF THE INVENTION

This invention relates to bell crank type mechanisms, to strip feeding apparatus employing bell crank mechanisms, and to a combined strip feeding and strip shearing apparatus.

BACKGROUND OF THE INVENTION

It is common practice to intermittently feed strip material by means of a reciprocating feed pawl which engages the strip during a feeding stroke thereby to push the strip in the direction of feeding. The feed pawl is often pivoted so that during the return stroke, the feed pawl can be dragged over the strip without pushing the strip in the reverse direction.

Feeding devices of the type briefly described above, whether they are of the bell crank type or of other types, can be troublesome if a high degree of precision is required in the strip feeding operation. For example, when the feed pawl is disengaged from the strip material, there may be a certain amount of "chattering" of the strip and/or the strip may be dragged in a reverse direction for a very short distance as a result of disengagement of the pawl. Furthermore, if the pawl remains in contact with the strip during the return stroke, the position of the strip on the feed path will be effected and the strip may vibrate or chatter as a result of the ratcheting effect of the pawl on the strip. If the operations being carried out on the strip material are relatively coarse, these effects are not troublesome, however, if precision stampings are being made, the slight movement of the strip brought about by the feeding mechanism causes substantial problems. For example, if the strip is being fed to a precision die, the slight movement of the strip in the die stations detracts from the dimensional precision of the finished parts. Also, if the strip material is in the form of precisely manufactured electrical terminals which are being fed to an assembly machine or to a crimping press, the misalignment of the strip in the assembly machine or in the crimping press will frequently give rise to inferior crimped connections.

The present invention is directed to the achievement of an improved strip feeding means of the bell crank type in which a high degree of precision in the feeding operation is obtained. Particularly, the invention is directed to the achievement of a bell crank type feeding mechanism in which the feed pawl is abruptly disengaged from the strip material being fed in a manner such that chattering or vibration in this strip at the end of the feeding stroke is virtually eliminated. The invention is also directed to the achievement of an improved feeding and shearing mechanism for a strip material and to an improved bell crank type mechanism which might be used in a variety of devices.

THE INVENTION

In accordance with one aspect thereof, the invention comprises a bell crank mechanism in which the bell crank has a first arm, a second arm, and a pivotal axis. Actuating means are provided for oscillating the first arm to and fro along a first arm oscillation path about the pivotal axis whereby the second arm is oscillated to and fro along a second arm oscillation path. The bell crank mechanism is characterized in that the actuating means comprises an actuator and an actuator coupling which is coupled to the first arm at a location which is spaced from the pivotal axis. The actuator is effective to impart circular motion to the actuator coupling along an essentially circular path with respect to a fixed center. The pivotal axis of the bell crank is supported by an axis supporting means for movement along an arcuate axis path in response to the circular motion of the actuator coupling. The axis supporting means in turn, is yieldable to permit movement of the pivotal axis laterally of the arcuate axis path. The movement of the second arm in one direction along the second arm oscillation path can thus be stopped as by engagement with a fixed stop. If the movement is thus stopped, the second arm and the pivotal axis will move laterally away from the second arm oscillation path with accompanying yielding of the axis supporting means laterally of the arcuate axis path.

In accordance with further embodiments, the actuator comprises a crank and the actuator coupling comprises a crank pin. The axis supporting means may comprise a supporting lever which is pivoted intermediate its ends and which has one end which is coupled to the pivotal axis of the bell crank by a connecting link. Biasing means are provided which act on the other arm of the supporting lever.

In accordance with a further embodiment, the invention comprises a strip feeding means having a bell crank mechanism as described above and having a strip engaging means, such as a feed pawl, on the second arm. A feed stop is provided which is engaged by the second arm prior to the end of the movement of the second arm in one direction so that the feed pawl is abruptly disengaged from the strip material.

In accordance with a further embodiment, a strip shearing means is provided in combination with the feeding means to perform shearing operations on the strip material which is fed.

THE DRAWING FIGURES

THE DISCLOSED EMBODIMENT

Figure 3:
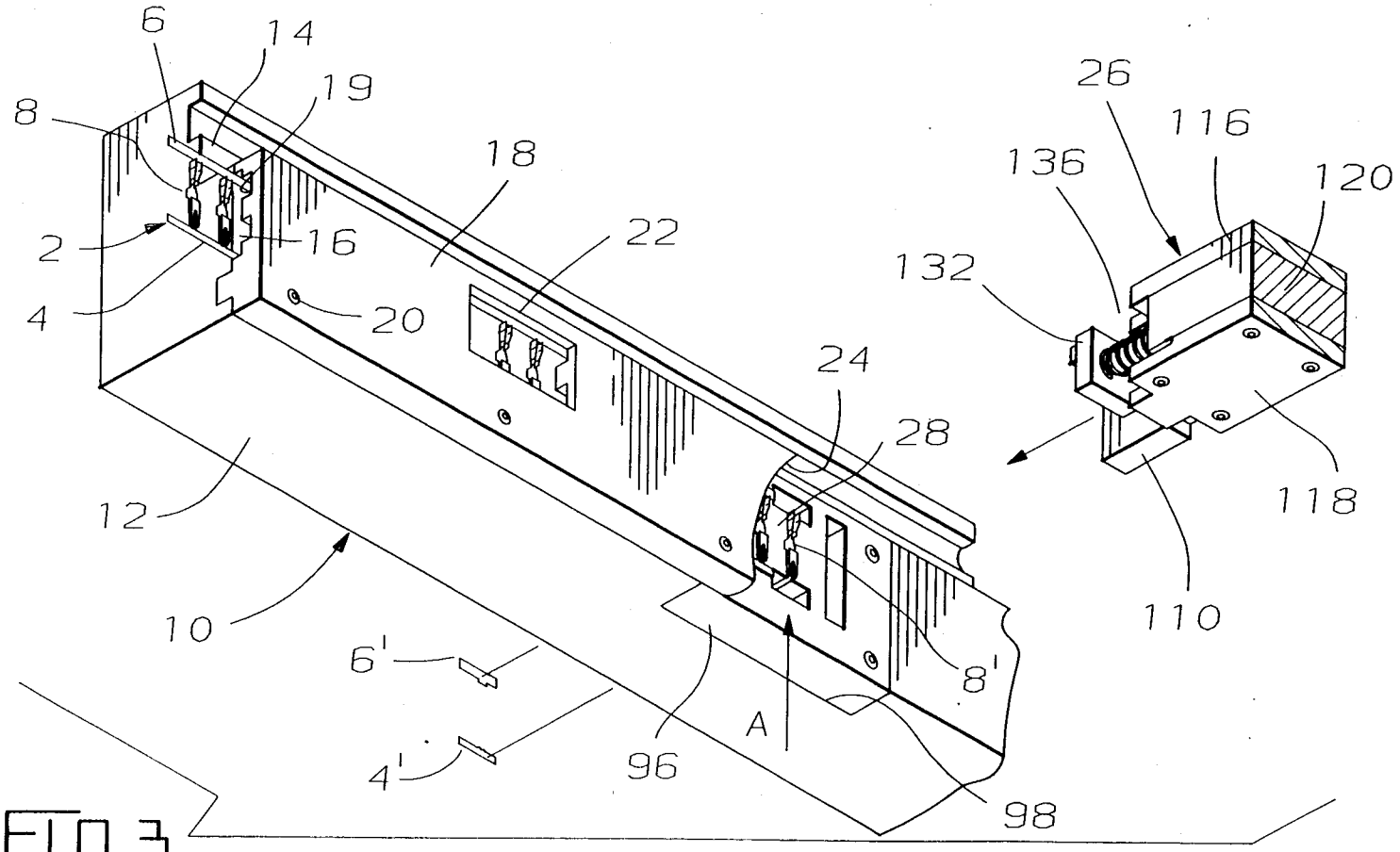
FIG. 3 is a perspective view showing the base assembly over which the strip material is fed and showing portions of the shearing assembly.

The specific embodiment of the invention disclosed herein feeds a strip 2 of electrical terminals 8 along a strip feed path to a shearing zone 28, FIG. 3, at which the leading terminal 8' is severed from the strip so that it can be transferred in the direction of the arrow in FIG. 3 and moved into a connector housing or the like. The strip 2 comprises spaced-apart parallel carrier strips 4, 6 with the terminals 8 extending between the carriers and integral at their ends with the carrier strips. When the leading terminal 8' is severed from the strip, the carrier strips are also severed so that short sections of scrap material 4', 6' are produced and eliminated.

The feeding and shearing assembly comprises a base assembly 10 having a base plate 12 with an upper surface 14. The central portion 16 of the upper surface provides support for the strip and functions as a strip feed path. A cover plate 18 is secured to the upper surface 14 by fasteners 20 and has an underside 19 which is contoured to provide clearance and guidance for the strip. A window 22 is provided in cover plate 18 to permit engagement of the feed pawl with the strip. The cover plate 18 extends to the shearing zone as shown at 24. The shearing assembly 26 is described in detail below.

Figure 1:
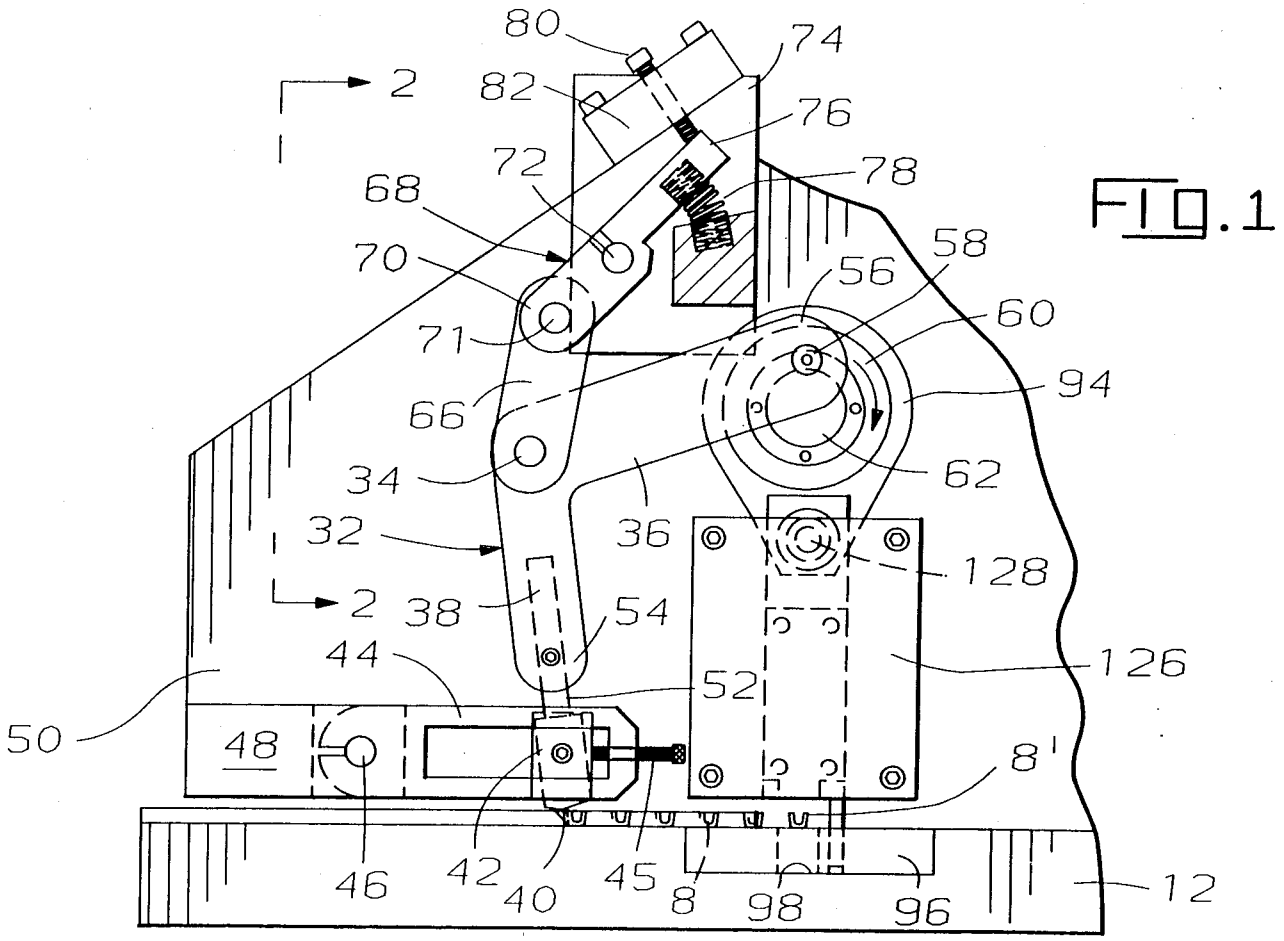
FIG. 1 is a frontal view of a feeding and shearing apparatus in accordance with the invention.
Figure 2:
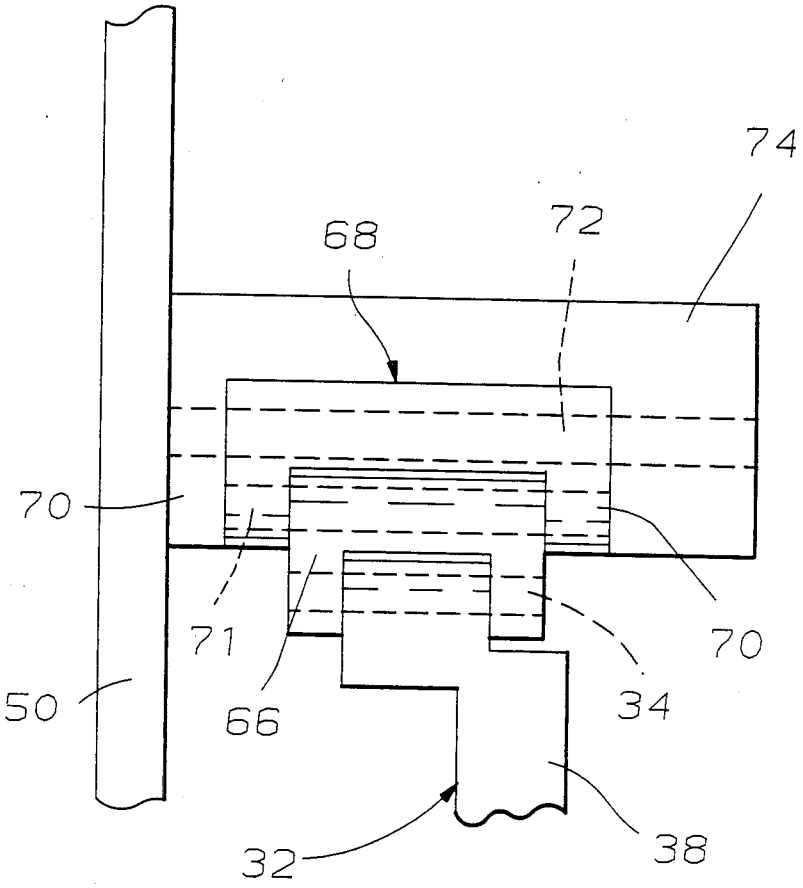
FIG. 2 is a view looking in the direction of the arrows 2—2 of FIG. 1.

The strip feeding assembly, FIGS. 1 and 2, comprises a bell crank 32 having a pivotal axis 34, a first arm 36, and a second arm 38. It should be noted that the pivotal axis 34 is not fixed but is movable along an arcuate path for reasons which will be explained below.

The feed pawl 40 for the strip material is mounted on a feed block 42 which is contained in a guide 44 and guided for to and fro motion. The right-hand end of the guide 44 is provided with an adjustable stop 45 in the form of a screw against which the block moves at the end of the feeding stroke. The guide 44 is pivoted as shown at 46 to an enlarged portion 48 of a vertical support plate 50 so that the entire guide including the feed block 42 can pivot upwardly from the position shown in FIG. 1. The feed block 42 has a bar or rod 52 extending upwardly therefrom which extends into an opening and is secured to the lower end of the second arm 38 of the bell crank.

The end 56 of the first arm 36 of the bell crank is coupled by means of a crank pin 58 to a collar 60 which is on the end of a shaft 62, the crank pin 58 extending into a suitable opening 59 in the collar. The crank pin is secured to the collar by a set screw 64. Additional sets screws are provided as shown to secure the collar to the shaft 62. It will thus be apparent that during rotation of the shaft 62 (which has a fixed center), the crank pin 58 will move along a circular path in a clockwise direction as indicated in FIG. 1. The pivotal axis 34 of the bell crank must therefore be free to move along an arcuate path and a supporting means for this pivotal axis is provided which permits such movement. This supporting means is yieldable and is described below.

The pivotal axis 34 is connected by a link 66 to one end 70 of a straight lever 68, this connection being in the form of a pin 71. The lever 68 is pivoted intermediate its ends as shown at 72 on a support block 74 which is in turn secured to the frame plate 50. The other end 76 of the lever 68 is biased in an anti-clockwise direction by a spring 78 which is also supported on block 74. This spring bears against the end 76 of lever 68 so that it is normally against the end of a stop screw 80 which is threaded through a support block 82 on the block 74.

The operation of the bell crank mechanism will be described with reference to the kinematic diagrams of FIGS. 5–8. These diagrams do not show the stop 45 which is required for the specific feeding means of the invention. The purpose and effect of the stop 45 will be described subsequently.

Figure 5:
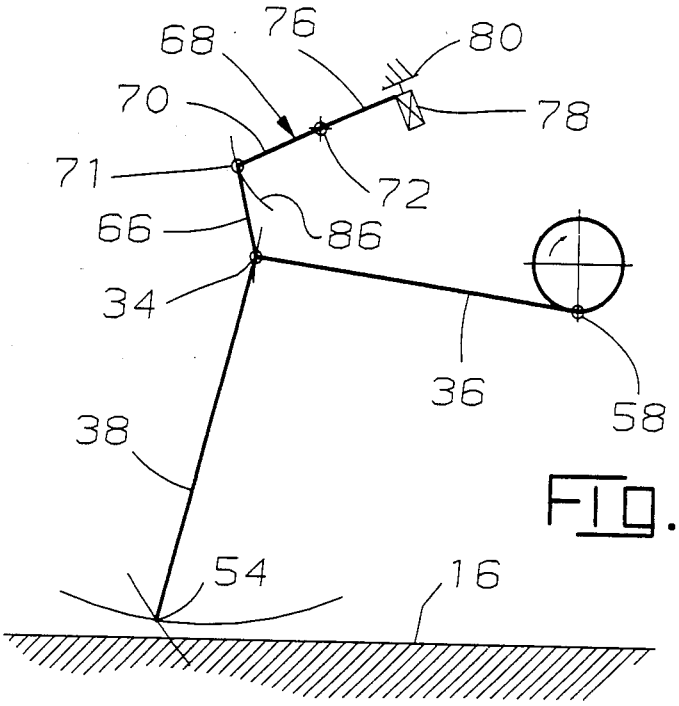
FIGS. 5–8 are kinematic diagrams which illustrate the operation of the bell crank mechanism of the invention.

FIG. 5 shows the positions of the parts when the second arm 38 has reached the limit of its leftward movement and the feed pawl 40, which is on the end 54 of arm 38, is therefore at the limit of its return stroke. As the crank pin 58 moves from the position of FIG. 5 to the position of FIG. 6, the end 54 of arm 38 moves a slight distance downwardly towards surface 16 and a short distance rightwardly. During movement of the crank pin from the position of FIG. 6 to the position of FIG. 7, the end 54 of arm 38 and the feed pawl move rightwardly along an arc of increasing radius until the limit of this rightward stroke is reached. The feeding of the strip takes place during this portion of the cycle. During movement of the crank pin from the position of FIG. 7 to the position of FIG. 8, the end of arm 38 moves arcuately upwardly and leftwardly along a path having a small radius so that the feed pawl is lifted above the surface 16. Thereafter, and during movement of the crank pin 58 back to the position of FIG. 5, the starting position, the end of arm 38 moves leftwardly. These movements are shown in FIGS. 5–8 to define a closed circuit path. It should be noted that the pivot pin 71 does not move when the bell crank mechanism is operated as described above, that is, when there is no stop 45 in the system.

Figure 6:
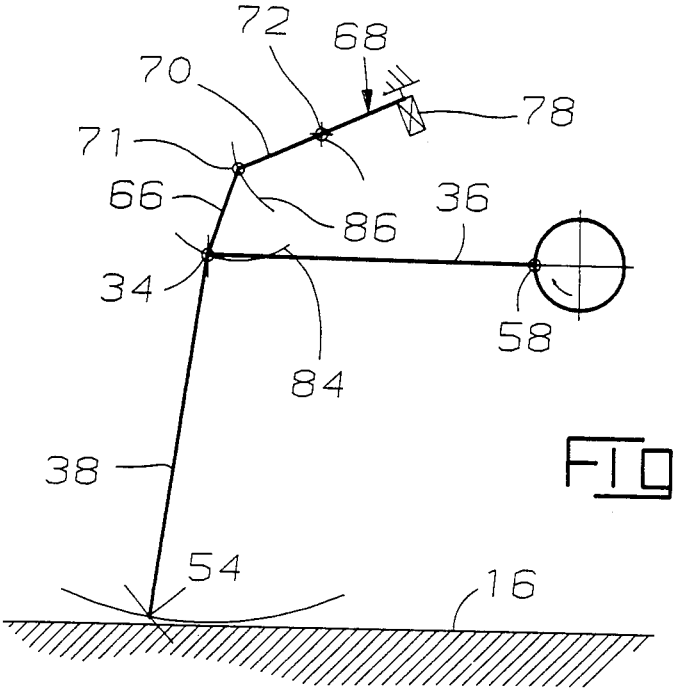

Since the pivot pin 71 does not move during the operating cycle described above, the pivotal axis 34 will move along an arcuate path as shown at 84 in FIG. 6. The pivot pin 71 is the center of thick arc 84. When the stop 45 is provided, the path followed by the pivotal axis is not an arc of constant radius but rather an arc of varying radius as described below.

Figure 9:
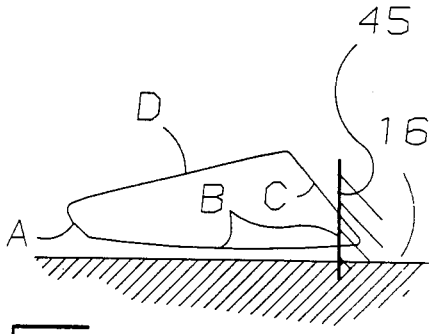
FIG. 9 is a diagram showing the path followed by the feed pawl.

FIG. 9 shows the closed circuit path followed by the feed pawl (that is by the end 54 of the arm 38) during an operating cycle. This figure also shows the stop 45 diagrammatically and illustrates the effect of the stop 45. Following is a table which correlates the movement of the feed pawl with the movement of the crank pin 58.

Figure 7:
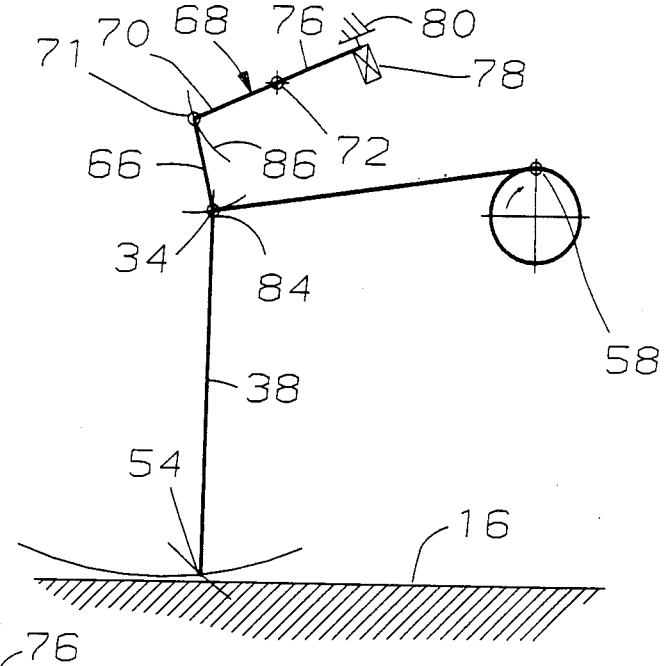
Figure 8:
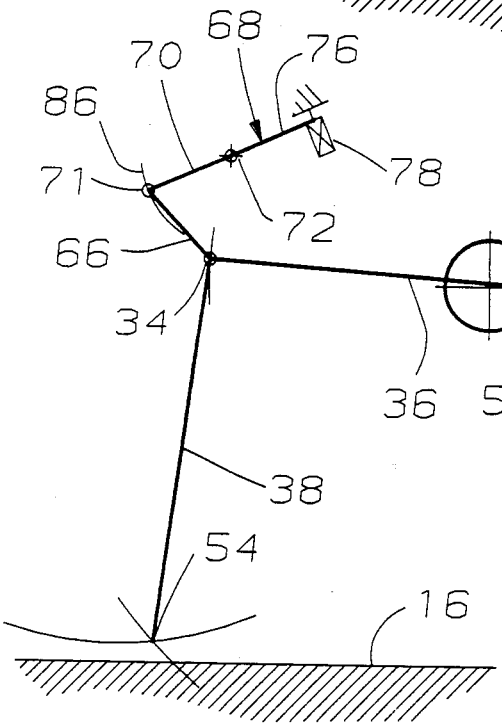

| Movement of Crank Pin 58 | Movement of Feed Pawl as shown in Figure 9 |
|---|---|
| FIG. 5 to FIG. 6 | A |
| FIG. 6 to FIG. 7 | B |
| FIG. 7 to FIG. 8 | C |
| FIG. 8 to FIG. 5 | D |

When the stop 45 is provided, as required in the present invention, the block 42 (FIG. 1) moves against the stop while the crank pin 58 is moving from the position of FIG. 6 to the position of FIG. 7 and preferably slightly before the crank pin arrives at the position of FIG. 7. During the interval between engagement of the block 42 with stop 45 and the arrival of crank pin 58 at the position of FIG. 7, the block 42 is forced to move abruptly upwardly as shown in FIG. 9. The arm 38 must also move upwardly, notwithstanding the fact that it is rotating in a clockwise direction with respect to pivot pin 34. The upward movement of block 42 and arm 38 is accommodated by movement of the pivot pin 71 along an arcuate path 86 so that the link 66 and pivot pin 34 move upwardly. The movement of link 66 and pin 71 is in turn accommodated by a slight clockwise rotation of the straight lever 68 with accompanying compression of spring 78. The spring subsequently returns the lever 68 to its normal position in which its end 76 is against adjustable stop 80.

A salient advantage of the invention is that high feeding speeds (in terms of feed strokes per minute) can be achieved. This advantage results from the fact that the parts are not reciprocated and are not stopped and started during each operating cycle as is done in reciprocating hitch feeds and in intermittent roll feeds which require starting and stopping of the feed rolls. As noted above, the feed pawl moves continuously along a closed circuit path. The mechanical wear of the parts is also reduced by virtue of the continuous movement and maintenance is thereby reduced with an accompanying improvement in the life expectancy of the mechanism. The arcuate movement of the feed pawl towards the surface 16, as shown in FIGS. 5–7, is desirable and advantageous in that the feed pawl can be brought gradually into engagement with the strip 2 during the feeding stroke. Extremely fine adjustments to the stroke may be made by stop 45 and this feature is desirable where the strip is composed of small terminals on closely spaced centers.

The shearing mechanism for shearing the leading terminal 8' from the strip and for severing the end portions of the carrier strips 4', 6', will now be described.

A fixed shearing block 96 is provided which is mounted in a recess 98 in the base 12, see FIG. 1. Shearing block 96 has spaced-apart openings 100, 102 through which movable shears 104, 106 are moved. The block 96 also has an opening 108 which receives a pilot arm 110 on the ram 120. The movable shear 106 has shearing edges 111, 112 which cooperate with edges of the opening 102 to shear the leading terminal from the carrier strip 4 and to shear the carrier strip 6. The movable shear 104 has a similar edge for shearing the carrier strip 6 and has a V-shaped projection which provides two edges 114. The movable shear 104 is of this form because the terminals must be sheared from the carrier strip 4 along two edges for the reason that each of the terminals has a plate-like member having a wire-receiving slot therein.

The movable shears 104, 106 are integral with, and extend from plates 116, 118 which are secured to opposite sides of ram 120 by suitable fasteners as shown. The ram 120 is received in a guideway 122 in a guide block 124. This guide block is supported on the plate 50 and is provided with a cover plate 126.

Figure 4:
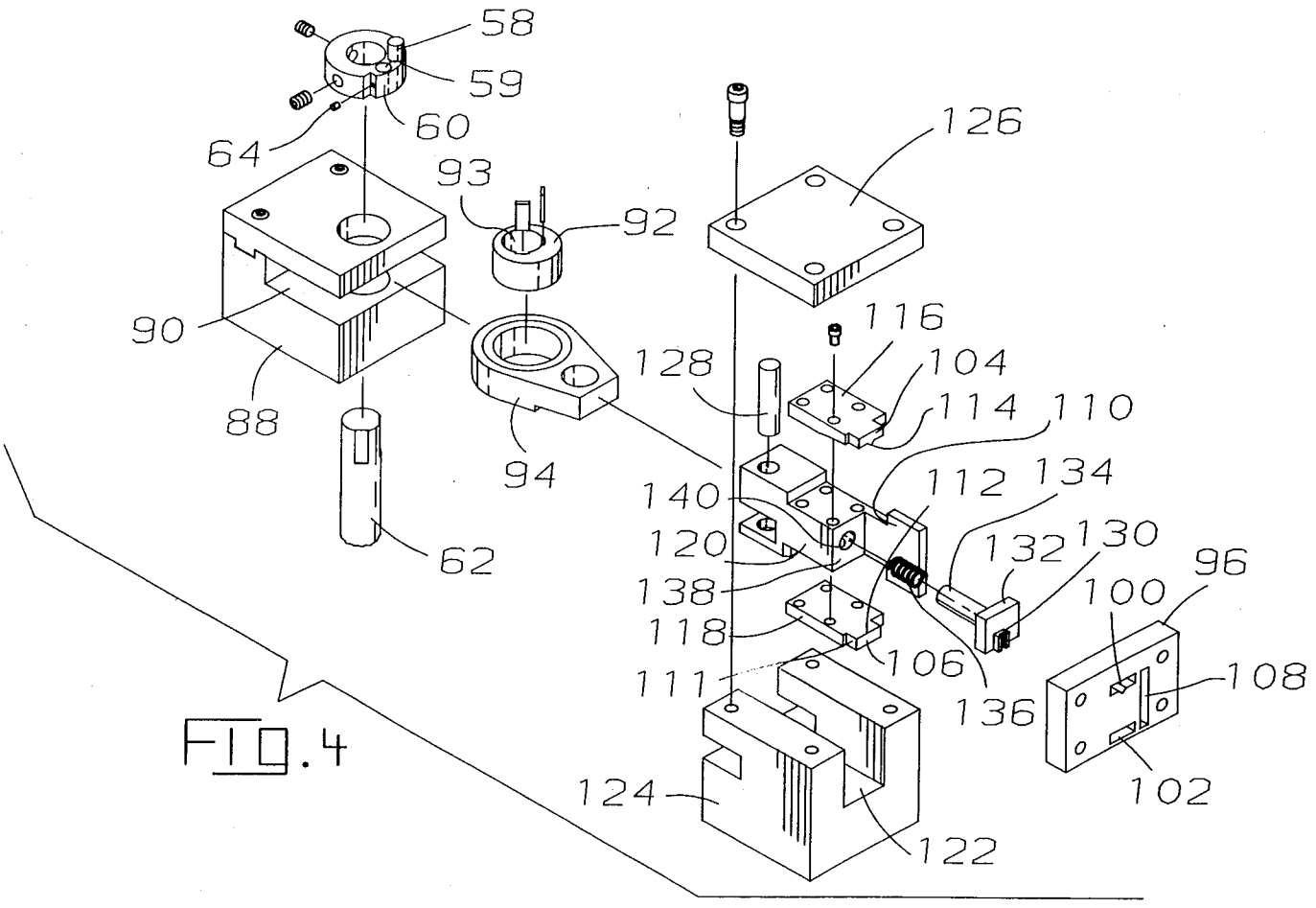
FIG. 4 is a perspective exploded view showing the shearing assembly and showing portions of the actuator for the strip feeding means.

The ram is reciprocated by an eccentric mechanism on the shaft 62. As shown in FIG. 4, the shaft extends through a recess 90 in a shaft support block 88. Within this recess, the shaft extends through, and is keyed to, an eccentric 92 having an eccentric opening 93 which receives the shaft. The eccentric 92 in turn is received in a bearing in a collar 94 so that continuous rotation of the shaft 62 will impart eccentric motion to the collar 94. The collar in turn is connected to the ram 120 by a connecting pivot pin 128. The collar has an extension which extends into a recess in the head portion of the ram through which the pin extends.

The disclosed embodiment also has a retainer or positioner 130 on the ram 120 for positioning and holding the severed terminal 8' in alignment with a transfer device (not shown) by means of which the severed terminal is transferred in the direction of the arrow of FIG. 3. The holder 130, FIG. 4, is essentially U-shaped and is secured to the face of a small block 132 on the end of a rod 134. This rod extends into an opening 140 in the end 138 of the ram 120 and a spring 136 is provided in this opening. This spring and rod arrangement permits the retainer to move in straddling relationship to the leading terminal prior to movement of the movable shears 104, 106 through the openings 100, 102. Obviously, overtravel of the ram relative to the rod is needed and such overtravel is achieved by virtue of the spring and rod arrangement.

It is believed that the operation of the shearing mechanism will be apparent from the foregoing description. Continuous rotation of the shaft 62 causes reciprocation of the ram 120 through the medium of the eccentric and collar device 92, 94. The eccentric 92 and the collar 60 must be fixed to the shaft relative to each other such that the feeding stroke will be completed before the shearing mechanism commences the shearing operations.

As previously noted, the bell crank mechanism described above can be used for a variety of purposes and is particularly advantageous for a feeding mechanism, the advantages of which are discussed in detail above. The specific embodiment shown herein has the added advantage of having a shearing mechanism which is coordinated with the feeding mechanism and which is driven from the same powder shaft as the feeding mechanism.

I claim:

1. A strip feeding mechanism for intermittently feeding strip material along a strip feed path, the feeding mechanism comprising a bell crank having a pivotal axis, a first arm and a second arm, the first and second arms extending from the pivotal axis, actuating means for oscillating the first arm to and fro along a first arm oscillation path about the pivotal axis and the second arm to and fro along a second arm travel path, and strip engaging means on the second arm, the strip engaging means being moved to and fro in a feeding stroke and a return stroke in response to the oscillation of the second arm, the strip feeding mechanism being characterized in that:

the actuating means comprises an actuator and an actuator coupling which is coupled to the first arm at a location which is spaced from the pivotal axis, the actuator being effective to impart circular motion to the actuator coupling along an essentially circular path with respect to a fixed center, the pivotal axis comprising a pivot means supported by an axis supporting means for movement along an arcuate axis path in response to the circular motion of the actuator coupling, a feed stop is provided for stopping the strip engaging means prior to the end of the feeding stroke, and the axis supporting means is yieldable to permit movement of the pivotal axis laterally of the arcuate axis path in response to engagement of the strip engaging means with the feed stop whereby, when the strip engaging means moves against the feed stop, feeding of the strip material abruptly stops, and during the remaining portion of the feeding stroke, the second arm moves laterally away from the strip feeding path with accompanying yielding movement of the axis supporting means laterally of the arcuate axis path.

2. A strip feeding mechanism as set forth in claim 1 characterized in that the actuator comprises a crank and the actuator coupling comprises a crank pin.

3. A strip feeding mechanism as set forth in claim 2 characterized in that the axis supporting means comprises a lever which is pivoted intermediate its ends, the pivotal means being connected to one end of the lever by a connecting link, the other end of the lever being biased on one direction by a biasing means.

4. A strip feeding mechanism as set forth in claim 3 characterized in that the biasing means comprises a spring, an adjustable stop being provided for the other end of the lever, the other end being biased by the spring against the adjustable stop.

5. A strip feeding mechanism as set forth in either of claims 1 or 4 characterized in that a shearing zone is provided, the feeding mechanism being effective to feed the strip material towards the shearing zone, and shearing means are provided in the shearing zone for shearing the strip.

6. A strip feeding mechanism as set forth in claim 5 characterized in that the shearing means comprises a reciprocable shearing punch.

7. A strip feeding mechanism as set forth in claim 6 characterized in that a single power shaft is provided, the shearing punch being reciprocated by the power shaft and the actuating means being powered by the power shaft.

* * * * *